United States Patent [19]

Takemae

[11] Patent Number: 4,729,746

[45] Date of Patent: Mar. 8, 1988

[54] BUOY HAVING EXCELLENT RESISTANCE AGAINST EXTERNAL PRESSURE

[75] Inventor: Eiji Takemae, Hiratsuka, Japan

[73] Assignees: The Yokohama Rubber Co., Ltd.; Japan Drilling Co., Ltd., both of Tokyo, Japan

[21] Appl. No.: 38,485

[22] Filed: Apr. 13, 1987

Related U.S. Application Data

[63] Continuation of Ser. No. 802,112, Nov. 25, 1985, abandoned.

[30] Foreign Application Priority Data

Nov. 28, 1984 [JP] Japan ..... 59-251368

[51] Int. Cl.[4] ..... B63B 22/00

[52] U.S. Cl. ..... 441/1; 441/6; 441/23

[58] Field of Search ..... 441/1, 3, 6–29, 441/74; 114/357

[56] References Cited

U.S. PATENT DOCUMENTS

| | | | |
|---|---|---|---|
| 3,077,614 | 2/1963 | Lloyd | 441/3 |
| 3,137,872 | 6/1964 | Edwards et al. | 441/14 |
| 4,457,729 | 7/1984 | Peerlkamp | 441/74 |

*Primary Examiner*—Sherman D. Basinger

*Attorney, Agent, or Firm*—Armstrong, Nikaido, Marmelstein & Kubovcik

[57] ABSTRACT

Disclosed is a buoy which comprises a high density polyethylene foam as a buoyant member, and an outer skin covering the surface of the foam. The buoy has excellent resistance against external force and the loss of the buoyancy by the reduction of the volume is minimized.

1 Claim, 3 Drawing Figures

BUOY HAVING EXCELLENT RESISTANCE AGAINST EXTERNAL PRESSURE

This application is a continuation of application Ser. No. 802,112, filed Nov. 25, 1985, and now abandoned.

BACKGROUND OF THE INVENTION

1. Field of the Invention

The present invention relates to a buoy having excellent resistance against external pressure. More particularly, it relates to a buoy having a buoyant member formed from a high density polyethylene foam and exhibiting a reduced loss of the buoyancy during use.

2. Description of the Prior Art

Buoys comprising a low density polyethylene foam as the buoyant member and an outer skin covering the foam have heretofore been used for anchoring ships or as observation and marking buoys. Such buoys are used by floating them on the surface of the water. However, about $\frac{2}{3}$ of the total volume is always submerged in water, and the submerged portion receives an external force from the water pressure. Accordingly, it is required that the buoys should float on the water surface while retaining a buoyancy capable of resisting the external pressure which the submerged portion receives during use.

In the conventional buoys, however, since a low density polyethylene foam in which a change of the volume by the external force is large is used as the buoyant members, and when the buoys receive the external force, the volume of the buoyant members is drastically reduced and the loss of the buoyancy is increased by reduction of the displacement. In an extreme case, there is no superfluous buoyancy and the buoys are entirely submerged in water.

In the conventional buoys, therefore, a structure having a large superfluous buoyancy should be adopted to cope with the reduction or the buoyancy by the external force, and therefore, the size of the buoys must be increased and the handling of the buoys becomes difficult.

SUMMARY OF THE INVENTION

It is therefore a primary object of the present invention to solve the above problem and provide a buoy having excellent resistance against external force, in which the loss of the buoyancy by the reduction of the volume is decreased.

In accordance with the present invention, there is provided a buoy having excellent resistance against external pressure, which comprises a high density polyethylene foam as a buoyant member and an outer skin covering the surface of the foam.

DESCRIPTION OF THE PREFERRED EMBODIMENTS

The buoy of the present invention will be described with reference to the accompanying drawings.

Figure 1:
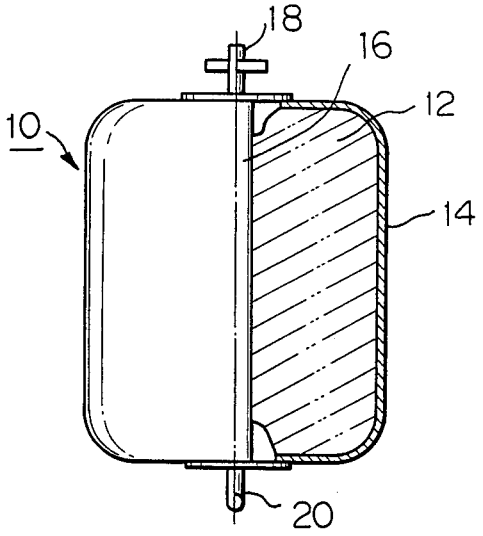
FIG. 1 is a partially sectional front view showing an embodiment of the buoy of the present invention.

Referring to FIG. 1, showing an example of the anchoring buoy, this buoy 10 has a columnar shape constructed by covering a buoyant member 12 composed of a high density polyethylene foam with an outer skin 14 composed of, for example, a rubber or a urethane rubber. A core fitting 16 is inserted through the upper and lower ends, a hang-up fitting 18 is attached to the top end portion of the core fitting 16, and a pendant wire connecting fitting 20 is attached to the lower end of the core fitting 16.

Figure 2:
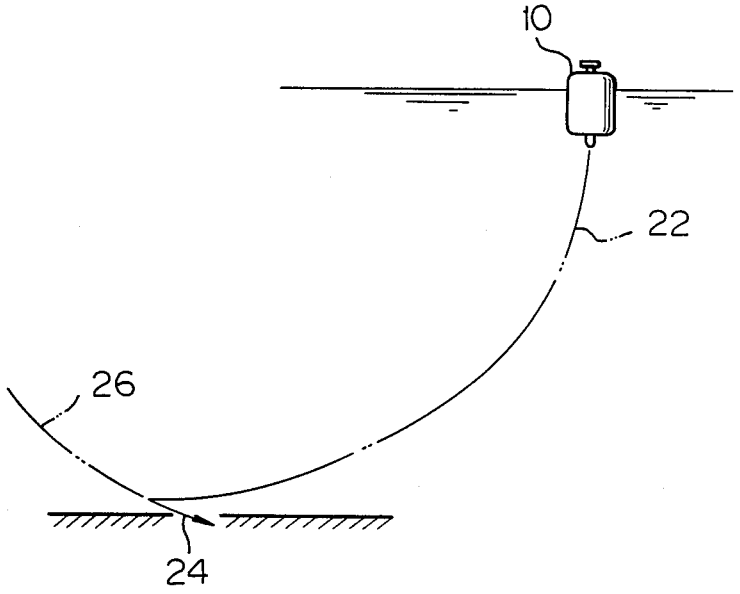
FIG. 2 is a side view showing the state where the buoy is actually used.

Referring to FIG. 2 showing a typical instance of the state of the buoy 10 in use one end of a pendant wire 22 is connected to the connecting fitting 20 of the buoy 10 floating in the state where about $\frac{2}{3}$ of the total volume is submerged below the water surface, and the other end of the pendant wire 22 is connected to an anchor 24 on the sea bottom. An anchor chain 26 hung down from a ship (not shown) is connected to the anchor 26.

Typical physical properties of a high density polyethylene which is the constituent material of the buoyant member 12 of the buoy 10 of the present invention and low density polyethylene used for the conventional buoy, before the foaming, are shown in Table 1 comparison's sake.

TABLE 1

| | High Density Polyethylene | Low Density Polyethylene |
|---|---|---|
| Specific gravity | 0.945–0.965 | 0.910–0.925 |
| Tensile strength (kgf/cm$^2$) | 218–386 | 70–161 |
| Elongation (%) | 15–100 | 50–650 |
| Heat distortion temperature (°C.) | 60–82 | 41–49 |
| Water absorption (%, 24 hours) | 0.01 | 0.015 |

Figure 3:
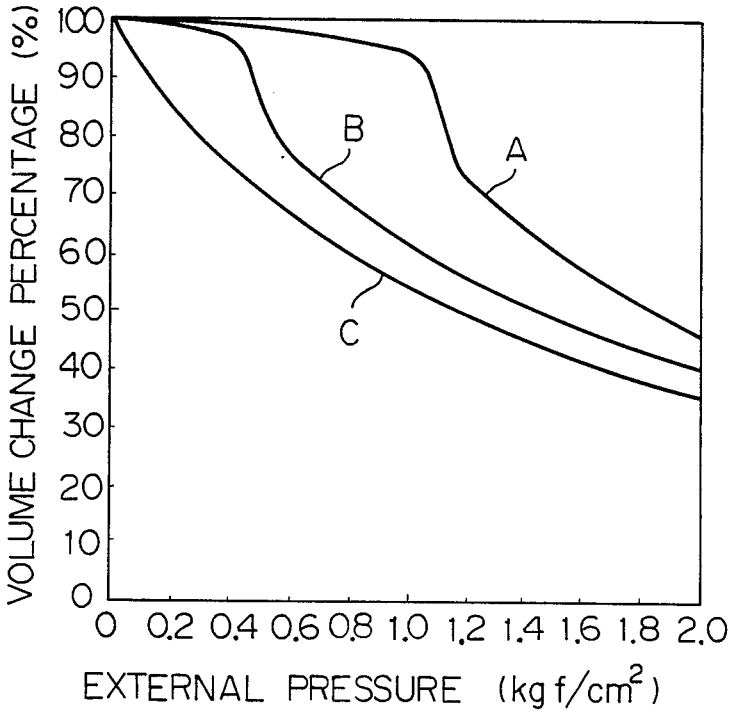
FIG. 3 is a graph illustrating the relation between the external pressure and the volume change ratio in a polyethylene foam.

The relations between the external pressure and the volume change ratio, observed in the high density polyethylene foam and the low density polyethylene foam, are shown in FIG. 3. In FIG. 3, curve A shows the above relation of a high density polyethylene foam having an expansion ratio of 22, curve B shows the above relation of a high density polyethylene foam having an expansion ratio of 30, and curve C shows the above relation of a low density polyethylene foam having an expansion ratio of 30.

As is apparent from the data shown in FIG. 3, the volume change ratio of the high density polyethylene foam is smaller than that of the low density polyethylene foam. In the high density polyethylene foam, a buckling phenomenon takes place if the external pressure exceeds a certain level, and the buckling point differs according to the expansion ratio. On the other hand, this buckling phenomenon is not caused in the low density polyethylene foam. Furthermore, even if the high density polyethylene foam undergoes an external pressure exceeding the buckling point, the volume change ratio is smaller than that of the low density polyethylene foam having the same expansion ratio. Thus, it will be readily understood that the high density polyethylene foam has excellent resistance against external pressure.

While the anchoring buoy is used, the submerged portion of the buoy receives the water pressure, and an external pressure of up to 0.3 kgf/cm$^2$ is always imposed on the lowermost end of the buoy. As shown in FIG. 3, the volume change ratio of the high density polyethylene foam under such an external pressure is much smaller than that of the low density polyethylene foam. Accordingly, the decrease of volume of the buoyant member is very small and the loss of buoyancy can be controlled to a minimum level.

The volume change ratio of the high density polyethylene foam varies according to the expansion ratio. Accordingly, various buoyant members differing in resistance against external pressure can be obtained by changing the expansion ratio, and buoys most suitable for the intended used and application conditions can be provided. The expansion ratio is usually in the range of 10 to 40.

As is apparent from the foregoing description, according to the present invention, the external pressure resistance of the buoyant member of the buoy can be improved and the loss of the buoyancy can be reduced. Accordingly, the loss of the buoyancy by the decrease of the volume need not be taken into consideration and the volume of the buoyant member can be reduced by a portion corresponding to the superfluous buoyancy. Therefore, the size of the buoy can be made smaller than that of he conventional buoy, and the handling of the buoy can be facilitated.

Furthermore, according to the present invention, the loss of buoyancy is much smaller than in the conventional buoy comprising a buoyant member of a low density polyethylene foam, when compared based on the same expansion ratio. Therefore, buoy having a large relative buoyancy can be provided according to the present invention.

I claim:

1. A buoy of the type, the volume of which varies depending upon the external pressure and which has excellent resistance against external pressure, comprising:

a high density polyethylene foam as a buoyant member and;

an outer skin covering the surface of the foam;

said polyethylene foam having an expansion ratio of 10 to 40 and made from a high density polyethylene having a specific gravity of 0.945 to 0.965 and a heat distortion temperature of 60° to 82° C.

* * * * *